US006726450B2

(12) United States Patent
Lee et al.

(10) Patent No.: US 6,726,450 B2
(45) Date of Patent: Apr. 27, 2004

(54) FAN HAVING SEALING DEVICE

(75) Inventors: Min-Chang Lee, Tu-chen (TW); Xi-Jian Zhu, Shenzhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/135,815

(22) Filed: Apr. 29, 2002

(65) Prior Publication Data

US 2003/0170121 A1 Sep. 11, 2003

(30) Foreign Application Priority Data

Mar. 8, 2002 (TW) ..... 91202776

(51) Int. Cl.[7] ..... F04D 29/10

(52) U.S. Cl. ..... 415/230; 415/220; 417/354; 417/423.12

(58) Field of Search ..... 415/230, 220, 415/229, 111–113; 417/354, 423.12; 310/67 R, 90; 384/132

(56) References Cited

U.S. PATENT DOCUMENTS 2,471,180 A * 5/1949 Wightman
3,188,153 A * 6/1965 Turk
3,726,575 A * 4/1973 Moorman ..... 308/135
4,955,791 A * 9/1990 Wrobel ..... 417/354
5,195,860 A * 3/1993 Steye ..... 411/526
5,441,386 A * 8/1995 Hsieh ..... 415/230
5,610,462 A * 3/1997 Takahashi ..... 310/90
6,274,958 B1 * 8/2001 Kobayashi et al. ..... 310/90
6,278,207 B1 * 8/2001 Matsumoto ..... 310/88
6,332,763 B1 * 12/2001 Kohsokabe et al. ..... 418/61.1

* cited by examiner

*Primary Examiner*—Edward K. Look
*Assistant Examiner*—J. M. McAleenan
(74) *Attorney, Agent, or Firm*—Wei Te Chung

(57) ABSTRACT

A fan (1) includes a housing (20), a vane assembly (40), and a sealing device (70). The housing includes a base portion (22), a bearing sleeve (24), a self-lubricating bearing (26) received in the bearing sleeve, and a lubricant insulation ring (28) received in the bearing sleeve. The vane assembly is rotatably attached in the housing, with a central rod (44) of the vane assembly extending through the bearing and the lubricant insulation ring. The sealing device is attached to the base portion such that the bearing is sealed in the bearing sleeve between the lubricant insulation ring and the sealing device. A sealing ring (80) of the sealing device is disposed in an annular groove (39) defined in the base portion, and is pressed tightly between the sealing lid and the base portion.

18 Claims, 5 Drawing Sheets

FAN HAVING SEALING DEVICE

BACKGROUND OF THE INVENTION

1. Field of the Invention

The present invention generally relates to fans having sealing devices, and particular to a fan with a device that conveniently seals lubricant in a bearing sleeve of the fan.

2. Description of the Prior Art

Referring to FIG. 5, a conventional electric fan 90 comprises a bearing sleeve 92, a self-lubricating bearing 94 located in the bearing sleeve 92, and a locking ring 96 located in the bearing sleeve 92 at one end thereof to confine the bearing 94. A lubricant insulation ring 97 at an opposite end of the bearing sleeve 92 prevents lubricant from leaking. A rotatable central rod 98 is held in the bearing 94.

In operation of the fan 90, the central rod 98 rotates, and centrifugal forces act on the lubricant and cause the lubricant to leak. After assembly of the fan 90, there is no means to check whether the locking ring 96 is still at its correct location or not. The locking ring 96 is liable to become ruined without warning, whereupon the entire fan 90 must be discarded. Many devices have good sealing apparatuses. Typical examples of such devices are disclosed in Taiwan Patent Applications Nos. 86217298 and 88204384. However, changing over the sealing apparatuses of such devices entails undue difficulty.

SUMMARY OF THE INVENTION

Accordingly, an object of the present invention is to provide a fan having a sealing device that can be conveniently assembled and detached.

To achieve the above-mentioned object, a fan of the present invention includes a housing, a vane assembly, and a sealing device. The housing includes a base portion, a bearing sleeve, a self-lubricating bearing received in the bearing sleeve, and a lubricant insulation ring received in the bearing sleeve. The vane assembly is rotatably attached in the housing, with a central rod of the vane assembly extending through the bearing and the lubricant insulation ring. The sealing device is attached to the base portion such that the bearing is sealed in the bearing sleeve between the lubricant insulation ring and the sealing device. A sealing ring of the sealing device is disposed in an annular groove defined in the base portion, and is pressed tightly between the sealing lid and the base portion.

Other objects, advantages and novel features of the present invention will become more apparent from the following detailed description when taken in conjunction with the accompanying drawings, in which:

DETAILED DESCRIPTION OF THE INVENTION

Figure 1:
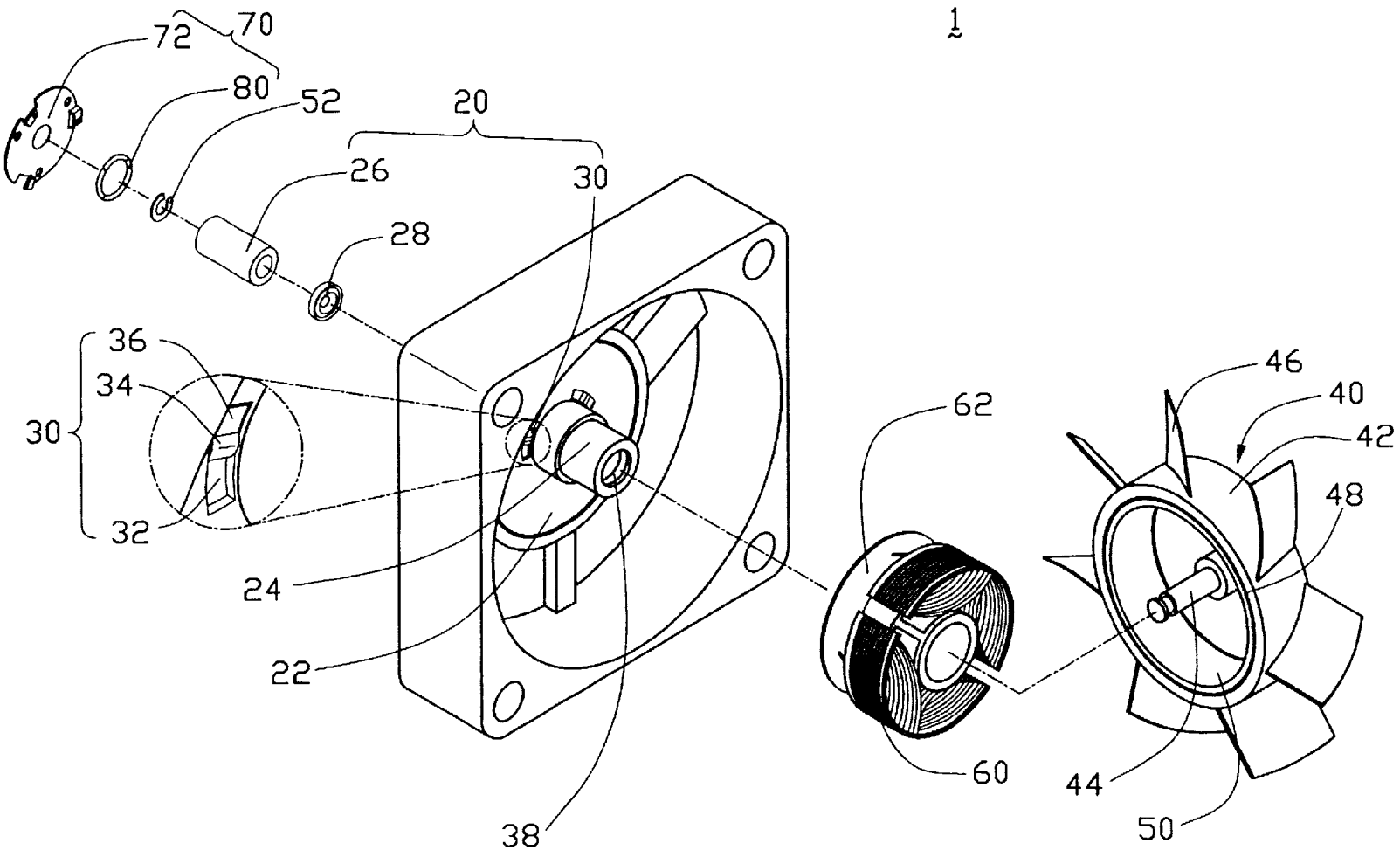
FIG. 1 is an exploded view of a fan in accordance with a preferred embodiment of the present invention.
Figure 2:
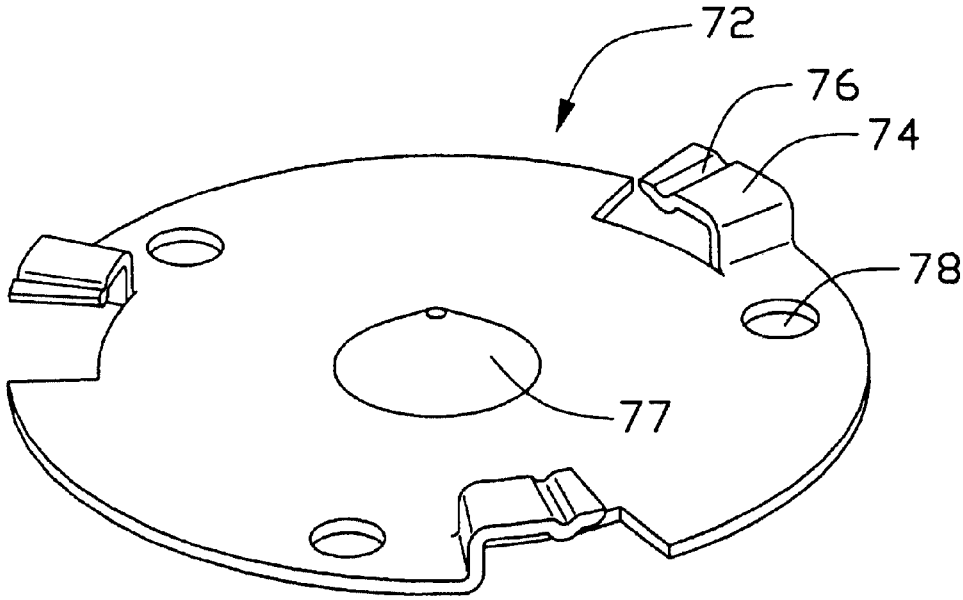
FIG. 2 is an enlarged perspective view of a sealing lid of a sealing device of the fan of FIG. 1.
Figure 3:
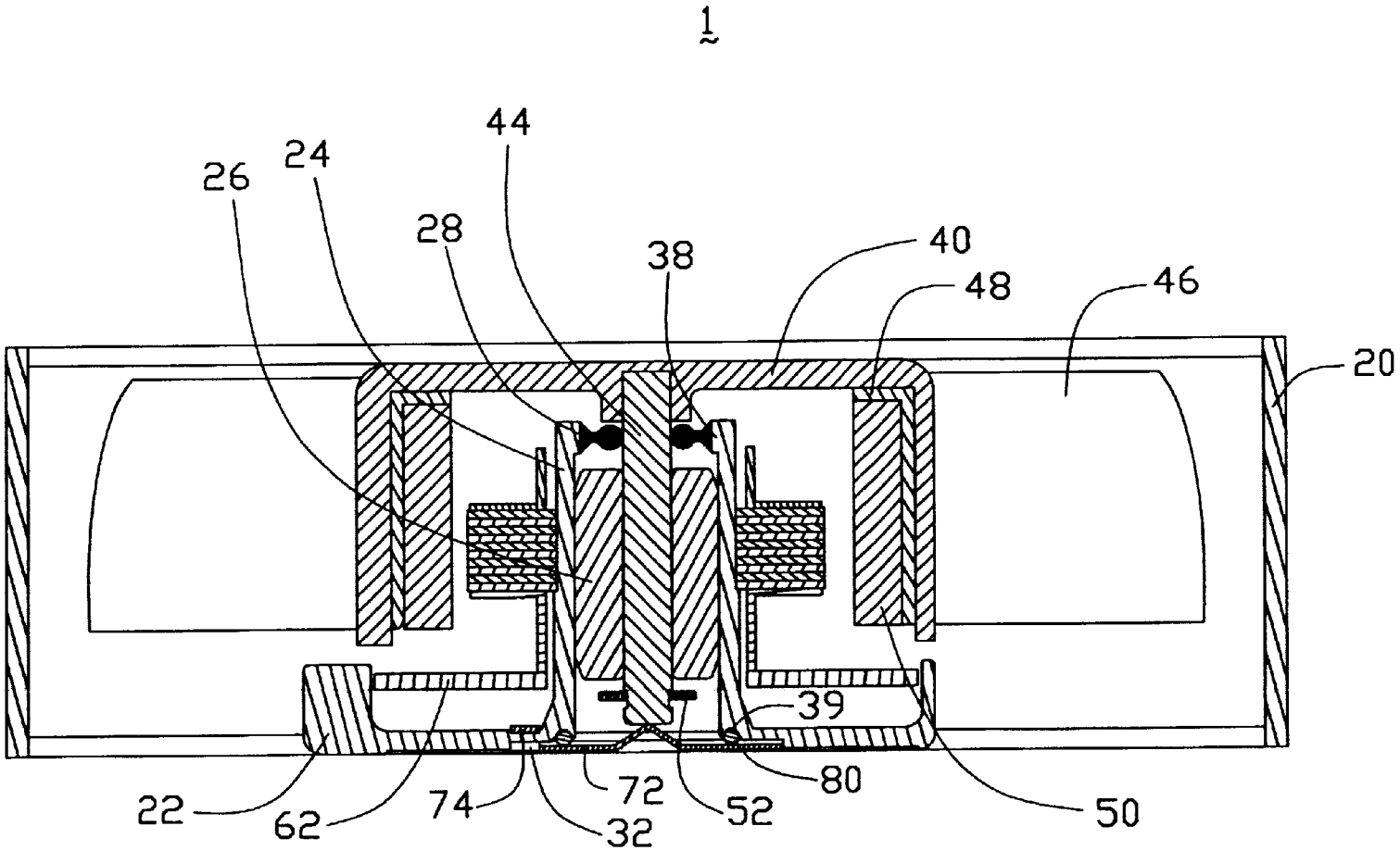
FIG. 3 is a cross-sectional view of the fan of FIG. 1 fully assembled.

Referring to FIGS. 1–3, a fan 1 in accordance with the present invention comprises a housing 20, a vane assembly 40, a stator 60 and a sealing device 70.

The housing 20 comprises a base portion 22, a bearing sleeve 24, a self-lubricating bearing 26, and a lubricant insulation ring 28. The base portion 22 is at a center of a main face of the housing 20. The bearing sleeve 24 extends inwardly from a center of the base portion 22. A plurality of evenly spaced receiving structures 30 is formed in the base portion 22 to encircle the bearing sleeve 24. Each receiving structure 30 comprises an aperture 32, a first protrusion 34 adjacent the aperture 32, and a recess 36 adjacent the first protrusion 34. An annular bead 38 is inwardly formed from a free end of the bearing sleeve 24. An annular groove 39 (see FIG. 3) is defined in an outer face of the base portion 22.

The vane assembly 40 comprises an annular pedestal 42, a central rod 44, and a plurality of evenly spaced vanes 46. The vanes 46 extend radially outwardly from a circumferential surface of the pedestal 42. An annular metallic shell 48 abuts an inner circular face of the pedestal 42. A magnet 50 abuts an inner circular face of the metallic shell 48. A locking ring 52 is for locking the central rod 44 in the bearing sleeve 24 of the housing 20.

The stator 60 has a circuit board 62 connected to a main face thereof.

The sealing device 70 comprises a sealing lid 72 and a sealing ring 80. A plurality of evenly spaced L-shaped holding fingers 74 extends from a periphery of a main face of the sealing lid 72, for insertion into the apertures 32 of the receiving structures 30 of the housing 20. A V-shaped second protrusion 76 is formed near a distal end of each holding finger 74. A dome 77 is formed at a center of the main face of the sealing lid 72, for supporting the central rod 44 of the vane assembly 40. A plurality of holes 78 is defined in the sealing lid 72, for engagingly receiving a tool (not shown).

In assembly of the fan 1, the stator 60 is slid over the bearing sleeve 24 of the housing 20. The stator 60 surrounds the bearing sleeve 24, and the circuit board 62 is disposed between the stator 60 and the base portion 22 of the housing 20. The lubricant insulation ring 28 is inserted into the bearing sleeve 24 so that it resiliently abuts against the bead 38 to prevent leakage of lubricant. The bearing 26 is inserted into the bearing sleeve 24 so that it is disposed near the lubricant insulation ring 28. The central rod 44 of the vane assembly 40 is inserted into the bearing sleeve 24 and through the lubricant insulation ring 28 and the bearing 26. The locking ring 52 is snappingly fixed around a terminal portion of the central rod 44, to keep the central rod 44 in place and confine the bearing 26. The sealing ring 80 is placed into the groove 39 of the housing 20. The holding fingers 74 of the sealing lid 72 are inserted into the apertures 32 of the receiving structures 30 of the housing 20. The tool (not shown) is engaged in the holes 78 of the sealing lid 72, and rotated so that the second protrusions 76 of the sealing lid 72 ride over the first protrusions 34 of the receiving structures 30 and into the recesses 36 of the receiving structures 30. The second protrusions 76 are thus resiliently and firmly engaged with the first protrusions 34. The sealing lid 72 is thus securely fixed on the outer face of the base portion 22. The sealing ring 80 is pressed tightly between the sealing lid 72 and the base portion 22. Lubricant is stored in a space (not labeled) surrounded by the sealing lid 72, the bearing 26, the bearing sleeve 24 and the sealing ring 80. Assembly of the fan 1 is thus completed. To disassemble the fan 1, the above procedure is performed essentially in reverse.

In operation of the fan 1, the circuit board 62 provides an alternating current to the stator 60, so the stator 60 creates an alternating magnetic field. The alternating magnetic field of the magnet 50 and a corresponding alternating magnetic field of the stator 60 act on each other to drive the pedestal 42 to rotate. The magnetic field center of the magnet 50 is higher than that of the stator 60, therefore the pedestal 42 urges the central rod 44 to firmly press the dome 77 and thus enhance the stability of the fan 1. The lubricant insulation ring 28 and the sealing ring 80 provide a tight seal, therefore the lubricant cannot leak out.

Figure 4:
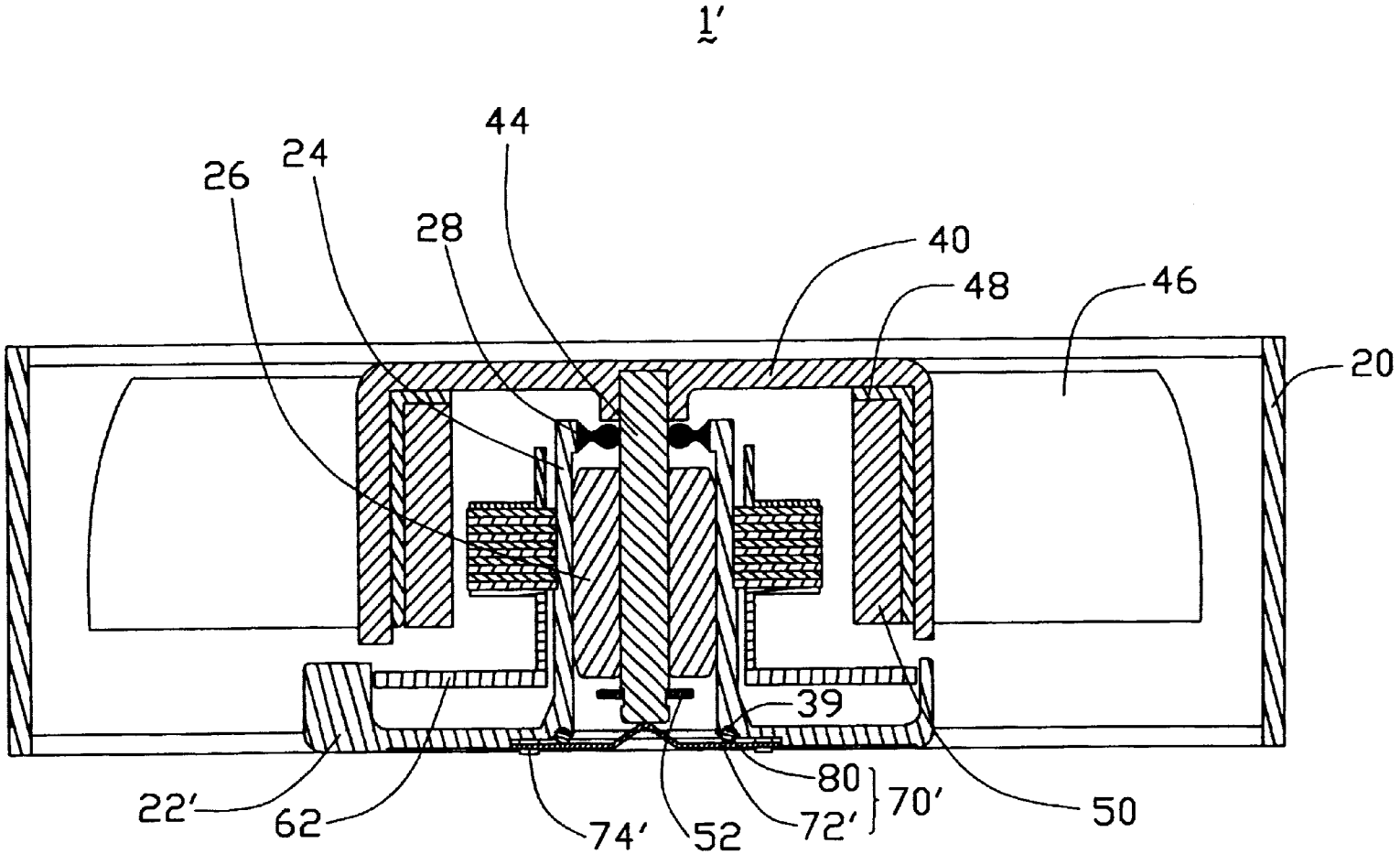
FIG. 4 is a cross-sectional view of a fan in accordance with an alternative embodiment of the present invention.
Figure 5:
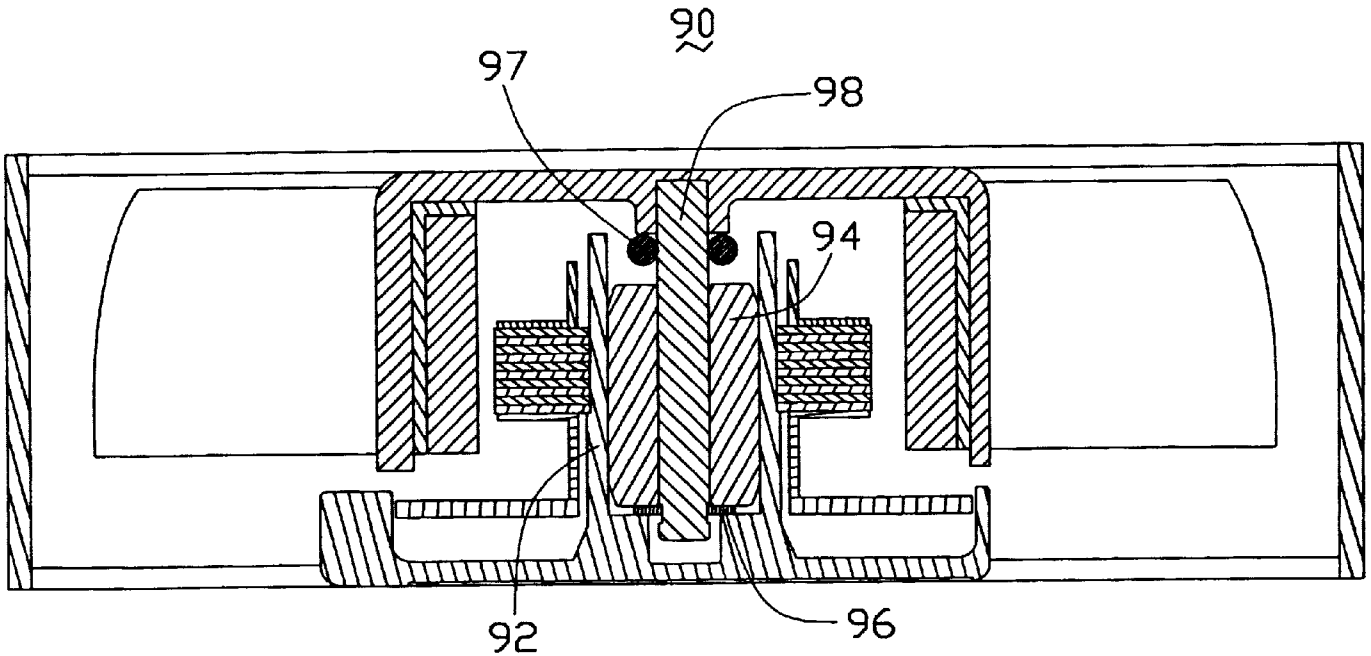
FIG. 5 (PRIOR ART)
FIG. 5 is a cross-sectional view of a conventional fan.

In an alternative embodiment of the present invention, the holding fingers 74 of the sealing lid 72 are interchanged with the receiving structures 30 of the base portion 22. Referring to FIG. 4, a fan 1' in accordance with the alternative embodiment comprises a plurality of holding fingers 74' extending from a base portion 22'. A plurality of receiving structures (not labeled) is formed in a sealing lid 72' of a sealing device 70'. The holding fingers 74' are inserted into apertures (not labeled) of the receiving structures (not labeled) of the sealing lid 72', such that the sealing lid 72' is tightly connected with the base portion 22'. Assembly of the fan 1' is similar to assembly of the fan 1 of the preferred embodiment. Reference is made to the foregoing description of assembly of the fan 1, with due alteration of details.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A fan comprising:

a housing comprising a base portion with a bearing sleeve at a center thereof, a self-lubricating bearing received in the bearing sleeve and a lubricant insulation ring received in the bearing sleeve at one distal end thereof distal from the base portion, wherein said base portion has an annular groove;

a vane assembly rotatably assembled to the housing, the vane assembly comprising a center rod extending through the lubricating ring and the self-lubricating bearing; and a sealing device attached to the base portion opposite the lubricating ring whereby the self-lubricating bearing is sealed between the lubricating insulation ring and the sealing device in the bearing sleeve.

2. The fan as claimed in claim 1, wherein the sealing device includes a sealing lid and a sealing ring.

3. The fan as claimed in claim 2, wherein the sealing lid comprises a plurality of holding members extending from a periphery of a main face of the sealing lid.

4. The fan as claimed in claim 3, wherein the base portion comprises a plurality of receiving structures arranged around a periphery of a bearing sleeve engaging with the holding members.

5. The fan as claimed in claim 2, wherein the sealing lid comprises a plurality of receiving structures arranged around a periphery of the bearing sleeve.

6. The fan as claimed in claim 5, wherein the base portion comprises a plurality of holding fingers extending from a periphery of a main face of the base portion engaging with the receiving structure.

7. The fan as claimed in claim 3 or 6, wherein each of the holding fingers comprises a second protrusion engaging with a first protrusion of a corresponding receiving structure.

8. The fan as claimed in claim 4 or 5, wherein each of the receiving structures comprises an aperture, a first protrusion adjacent the aperture, and a recess defined adjacent the first protrusion.

9. The fan as claimed in claim 2, wherein the sealing lid comprises a dome for supporting the center rod.

10. The fan as claimed in claim 2, wherein the sealing lid defines a plurality of holes for receiving a tool therein.

11. The fan as claimed in claim 2, wherein an outer face of the base portion defines an annular groove receiving the sealing ring.

12. The fan as claimed in claim 1, wherein the sealing ring is pressed tightly between the sealing lid and the base portion.

13. The fan as claimed in claim 1, wherein the bearing sleeve comprises a bead disposed at said distal end of the bearing sleeve that is distal from the base portion.

14. The fan as claimed in claim 13, wherein the lubricant insulation ring is disposed in the bead, and the bearing is near the lubricant insulation ring in the bearing sleeve.

15. A sealing device of a fan comprising:

a sealing lid rotatably attached to a base portion of a housing of a fan, the sealing lid comprising a plurality of engaging means at a peripheral thereof, wherein when the sealing lid is rotated between first and second positions, the engaging means engages with and disengages from the base portion the housing;

a sealing ring disposed in an annular groove which is defined in the base portion, said sealing ring pressed tightly between the sealing lid and the base portion; wherein said sealing lid comprises a dome for supporting a central rod of a vane pedestal of the fan.

16. The sealing device as claimed in claim 15, wherein the engaging means of the sealing lid comprises a plurality of holding fingers engaging with corresponding a plurality of receiving members of the base portion.

17. The sealing device as claimed in claim 15, wherein the engaging means of the sealing lid comprises a plurality of receiving member engaging with a plurality of holding fingers of the base portion.

18. A fan comprising:

a housing comprising a base portion with a bearing sleeve at a center thereof, a self-lubricating bearing received in the bearing sleeve and a lubricant insulation ring received in the bearing sleeve at one distal end thereof distal from the base portion, wherein said base portion has an annular groove;

a vane assembly rotatably assembled to the housing in a front-to-back direction, the vane assembly comprising a center rod extending through the lubricating ring and the self-lubricating bearing; and a sealing device detachably attached to the base portion in a back-to-front direction, opposite to said vane assembly wherein sealing device provides abutment against the central rod for enhancing stability of the fan;

wherein the self-lubricating bearing is sealed between the lubricating insulation ring and the sealing device, and a sealing ring is located at the other end of the bearing sleeve and tightly sandwiched between the bearing sleeve and the sealing device, wherein said sealing ring is received in said annual groove.

* * * * *